United States Patent [19]

Moeller et al.

[11] 4,031,459

[45] June 21, 1977

[54] INDUCTIVE VOLTAGE TRANSFORMER FOR A HIGH-VOLTAGE METAL-CLAD SWITCH-GEAR INSTALLATION

[75] Inventors: Jürgen Moeller, Memmelsdorf; Werner Mitrach, Bamberg; Helmut Krauss, Geisfeld; Hubert Schulte, Bischberg, all of Germany

[73] Assignee: Messwandler-Bau GmbH, Germany

[22] Filed: Oct. 30, 1975

[21] Appl. No.: 627,272

[30] Foreign Application Priority Data

Nov. 2, 1974 Germany ..... 2452056

[52] U.S. Cl. ..... 323/60; 336/70; 336/84; 336/92

[51] Int. Cl.[2] ..... H01F 15/04

[58] Field of Search ..... 336/84, 69, 70, 90, 336/92, 94; 323/60, 61

[56] References Cited

UNITED STATES PATENTS

| | | | |
|---|---|---|---|
| 1,709,054 | 4/1929 | Bennett | 336/84 |
| 3,175,173 | 3/1965 | Welch | 336/84 |
| 3,380,009 | 4/1968 | Miller | 336/84 X |
| 3,441,885 | 4/1969 | Marks | 336/84 |
| 3,456,222 | 7/1969 | Berg | 336/84 X |

FOREIGN PATENTS OR APPLICATIONS

| | | | |
|---|---|---|---|
| 337,143 | 2/1936 | Italy | 336/84 |

*Primary Examiner*—Thomas J. Kozma
*Attorney, Agent, or Firm*—Craig & Antonelli

[57] ABSTRACT

An inductive voltage transformer for a high-voltage metal-clad switch-gear installation fully insulated by means of an insulating gas, which includes a pressure vessel flangedly connected to the metallic capsule of the switch-gear installation and has a high-voltage winding constructed as layer winding which is surrounded by the high-voltage electrode; the insulating gas disposed within the pressure vessel thereby forms the high-voltage insulation while the high voltage electrode is drawn axially over the winding end faces of at least a portion of the layer winding; the central portion of the high-voltage electrode surrounding the winding cross section of the layer winding as well as the edge portions thereof axially drawn beyond the layer winding are thereby so curved that the outer surfaces thereof form together with the adjacent cylindrical wall portions of the pressure vessel at least approximately a Rogowski-profile projected on a cylindrical area.

45 Claims, 5 Drawing Figures

Figure 1A:
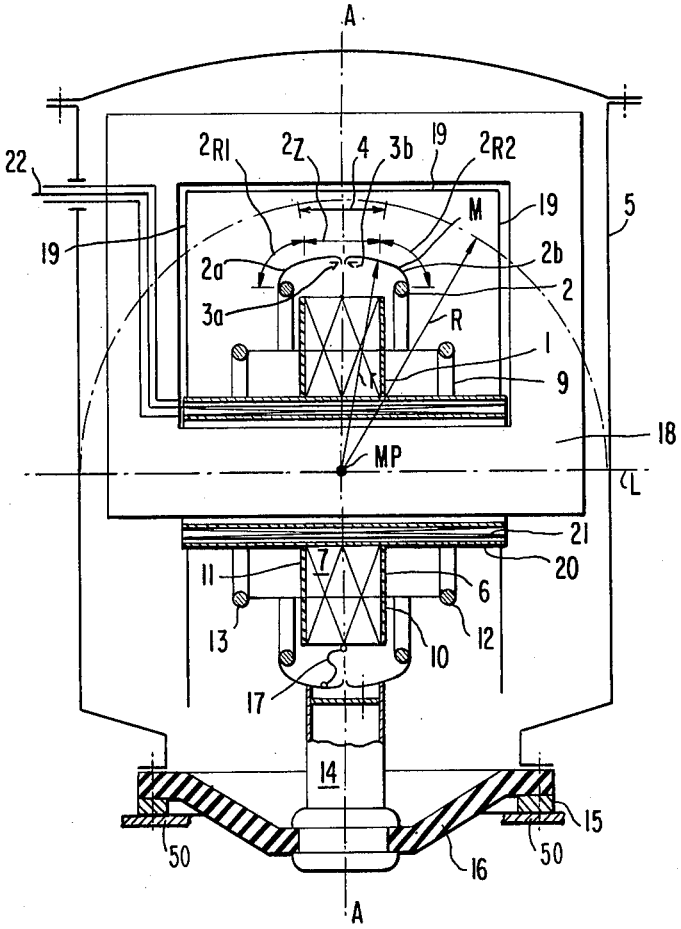

INDUCTIVE VOLTAGE TRANSFORMER FOR A HIGH-VOLTAGE METAL-CLAD SWITCH-GEAR INSTALLATION

The present invention relates to an inductive voltage transformer for a high-voltage metal-clad switch-gear installation fully insulated by means of an insulating gas, with a pressure vessel adapted to be flangedly connected in a gas-tight manner to the metal encapsulation of the switch-gear installation and with a high-voltage winding constructed as a layer winding, which is surrounded by a high-voltage electrode coaxially surrounding the same, whereby the insulating gas present in the pressure vessel forms the high-voltage insulation.

The use of metal-clad switch-gear installations fully insulated by means of insulating gas, which has increased in recent times, has also furthered the development of current- and voltage-transformers which can be used in these installations.

Different types of voltage transformers have become known which can be used preferredly, depending on the predetermined operating voltage of a high-voltage metal-clad switch-gear installation.

An inductive voltage transformer for a high-voltage metal-clad switch-gear installation which is fully insulated by means of an insulating gas, is described in the German Auslegeschrift No. 1,807,997 whose primary and secondary windings are insulated with respect to one another and with respect to the grounded pressure vessel by means of an insulating body of synthetic resinous insulating material. The high-voltage insulation is therefore formed by the synthetic resinous insulating member, whereas the insulating gas present in the pressure vessel serves exclusively as corrosion protection for the active transformer parts. Since with castings of larger weight the difficulties to provide a cast synthetic resinous insulation without blow holes, air enclosures or other defective places greatly increase, the use of such types of voltage transformers insulated by synthetic resinous materials for fully insulated, high-voltage metal-clad switch-gear installations is limited to the lower high-voltage range up to about 145 kV.

In principle, an inductive voltage transformer with a high-voltage winding that represents a stepped, self-supporting, cascade-shaped winding connection, as described in the German Auslegeschrift No. 2,113,617, is suited for higher voltage ranges. In this prior art voltage transformer, the winding parts forming the winding connection are impregnated and cast about with an impregnating resin and the necessary connecting bridges between the individual winding parts is formed thereby by the impregnating synthetic resinous material. Since this voltage transformer includes only comparatively small partial coils, the impregnating of the partial coils or the molding or casting about with the impregnating synthetic resin is not critical. On the other hand, it causes difficulties to so manufacture the connecting bridges between the partial coils that the coil connection which for electrical reasons is constructed freely supporting, i.e., in a cantilever manner, receives a sufficient mechanical strength.

Finally, an inductive voltage transformer of a high-voltage metal-clad switch-gear installation fully insulated by means of an insulating gas is described by the list leaflet (listenblatt) E 24.01.02/0773 of the company AEG-TELEFUNKEN, whose high voltage insulation is formed solely by the insulating gas present in the pressure vessel of the voltage transformer, preferably by $SF_6$. The high-voltage winding is surrounded by a high-voltage electrode which is connected with the contact is surface for the connection to the switch-gear installation by means of a funnel support.

The present invention starts with an inductive voltage transformer of the last-mentioned type in which the insulating gas of the switch-gear installation or the insulating gas introduced from there into the pressure vessel of the voltage transformer forms itself the high-voltage insulation of the transformer.

The present invention is concerned with the task to so construct an inductive voltage transformer for a high-voltage metal-clad switch-gear installation of the aforementioned type fully insulated by means of an insulating gas that the spatial dimensions of the pressure vessel, the required insulating gas volume and the weight of the transformer can be kept as small as possible. The underlying problems are solved according to the present invention in that the high-voltage electrode is axially drawn forwardly over the winding end faces at least of a part of the layer winding and the central portion including the winding cross section of the layer winding as well as the edge portions of the high-voltage electrode axially drawn over the layer winding are so curved that the outer surfaces thereof together with the adjacent wall parts of the pressure vessel adjacent thereto form at least approximately a Rogowski-profile projected on a cylindrical area.

By drawing inwardly the edge portions of the high-voltage electrode in the direction toward the winding longitudinal axis to an extent that the high-voltage electrode—outer surfaces together with the cylindrical wall portions of the pressure vessel adjacent thereto form a Rogowski-profile projected on a cylindrical area or field—one not only obtains and optimum shielding but therebeyond a uniform surface field strength at all places of the high-voltage electrode. This is so because with a spatial electrode arrangement having a Rogowski-profile projected onto a cylindrical area as also with a plate-electrode arrangement having a Rogowski-profile, the entire electrode surface inclusive the rounded-off edge portions forms an equipotential surface so that the electric field strength is also not larger at the electrode edges than in the interior space between the electrodes. As a result thereof, the dielectric stress of the insulating gas can be selected comparatively high because field concentrations and therewith non-permissively high dielectric stresses do not occur. This enables, independently of the pressure of the insulating gas used in the pressure vessel, preferably sulfahexafluoride, perfluoropropane or the like, to keep optimally small the insulating distance between the high-voltage electrode and the pressure vessel which is at ground potential. This leads with cylindrical pressure vessels to smaller vessel diameters, therewith to smaller gas volumes and finally also to savings in weight. The latter is of significance in particular with the frequently used steel plate pressure vessels. Added thereto is the fact that the present invention in particular also meets or favors the requirement for smaller field distributions in fully insulated, high-voltage metal-clad switch-gear installations or enables a more convenient assembly with the same field distribution.

The layer winding includes advantageously one or several intermediate electrodes axially projecting beyond the winding end faces, whose free ends are enlarged trumpet-shaped toward the outside. By the use of one or several intermediate electrodes, the shielding and the field uniformity are still further improved. Additionally, one obtains a more favorable surge voltage strength of the high-voltage winding. Field concentrations are far-reachingly avoided by the trumpet-shaped construction of the intermediate electrode edges. Simultaneously therewith, a material-, weight- and space-saving will result because the enlargement of the electrode edges, necessary for achieving a large radius of curvature are provided only within the area of high field strengths.

It is additionally of advantage if the high-voltage electrode and/or the intermediate electrode or electrodes preferably consist of assembled sheet-metal stampings or pressed-out sheet-metal parts. This leads to a considerable weight-saving compared to the customary shielding electrodes made of solid material, especially if the sheet-metal stampings or pressed-out sheet-metal parts are made of light-metal. It is also favorable if the high-voltage electrode is assembled of two symmetrical sheet-metal stampings or pressed-out sheet-metal parts which are preferably detachably connected with each other. The subsequent assembly and installation of the high-voltage electrode is considerably simplified thereby.

A construction of the high-voltage electrode which is particularly favorable from an assembly and installation point of view will exist if the sheet-metal stampings or pressed-out sheet-metal parts are connected with each other by means of a bayonet connection.

In order to further economize weight and to obtain a uniform, mechanically sturdy high-voltage winding, it is furthermore favorable if the intermediate electrode or electrodes are constructed as metal tapes or webs and are wound into the layer winding and if the edges thereof, preferably made of sheet-metal stampings or pressed-out sheet-metal parts, are connected with the intermediate electrode tape or web by means of soldering, riveting or the like.

In order to obtain separate fastening points for the active parts of the high-voltage transformer with respect to the vessel, on the one hand, and the support of the high-voltage outlet line or lead-out at the terminal insulator, on the other, it is of advantage if the high-voltage electrode is secured at the high-voltage outlet line or lead out and surrounds the layer winding freely supporting or if the high-voltage electrode is secured on the layer winding by means of a clamping fit and the high-voltage outlet line or lead-out is flexibly connected with the high-voltage electrode. A spoke-shaped support of the high-voltage electrode on the layer winding is advantageous in particular as a clamping-fit fastening means.

It is of advantage for damping discharge currents of lines operating under no-load conditions, if the spoke-shaped support elements consist of a resistance-material or if the high-voltage outlet line itself consists of resistance material or contains a winding of resistance wire.

If some value is placed on a uniform a.c. voltage distribution, it is of advantage if the layer winding surrounded by the high-voltage electrode has a rectangular winding cross section.

The surge-voltage strength of the high-voltage winding and the classification accuracy of the voltage transformer according to the present invention can be still further improved if the layer winding is provided with rectangular winding cross section offset once or several times, and if an intermediate electrode axially projecting over the winding edge is provided at each winding step and if the width of the winding steps decreases with increasing potential.

In cases where a far-reachingly uniform inductive and capacitive voltage distribution is of importance, it is of advantage if the layer winding surrounded by the high-voltage electrode has a trapezoidally shaped winding cross section. Optimum conditions exist in this connection if the layer winding surrounded by the high-voltage electrode has a layer width that decreases continuously in the direction toward increasing potential, whereby the layer width is so dimensioned in dependence on the number of layers that the inductive and the capacitive voltage distribution are at least approximately equal to one another.

It is of particular advantage if the individual winding layers and the layer insulations are so fastened that the transformer can be flangedly connected to the high-voltage switch-gear installation in any desired installed position. A sufficient fastening of the high-voltage winding can be achieved, for example, by gluing or bonding the winding layers and/or the layer insulations or by the manufacture of a sufficiently soft surface of the layer insulations in such a manner that the individual wire windings are forced into the soft surface by the winding pull or tension. As a result thereof, the transformer can be flangedly connected to the high-voltage switch-gear installation in the main installed positions with a horizontal, downwardly inclined or upwardly pointing terminal insulator and even in intermediate positions with an inclined winding main axis.

Figure 1B:
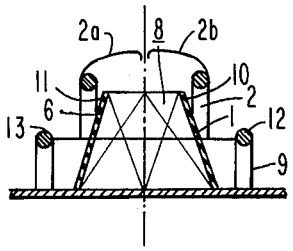
Figure 2A:
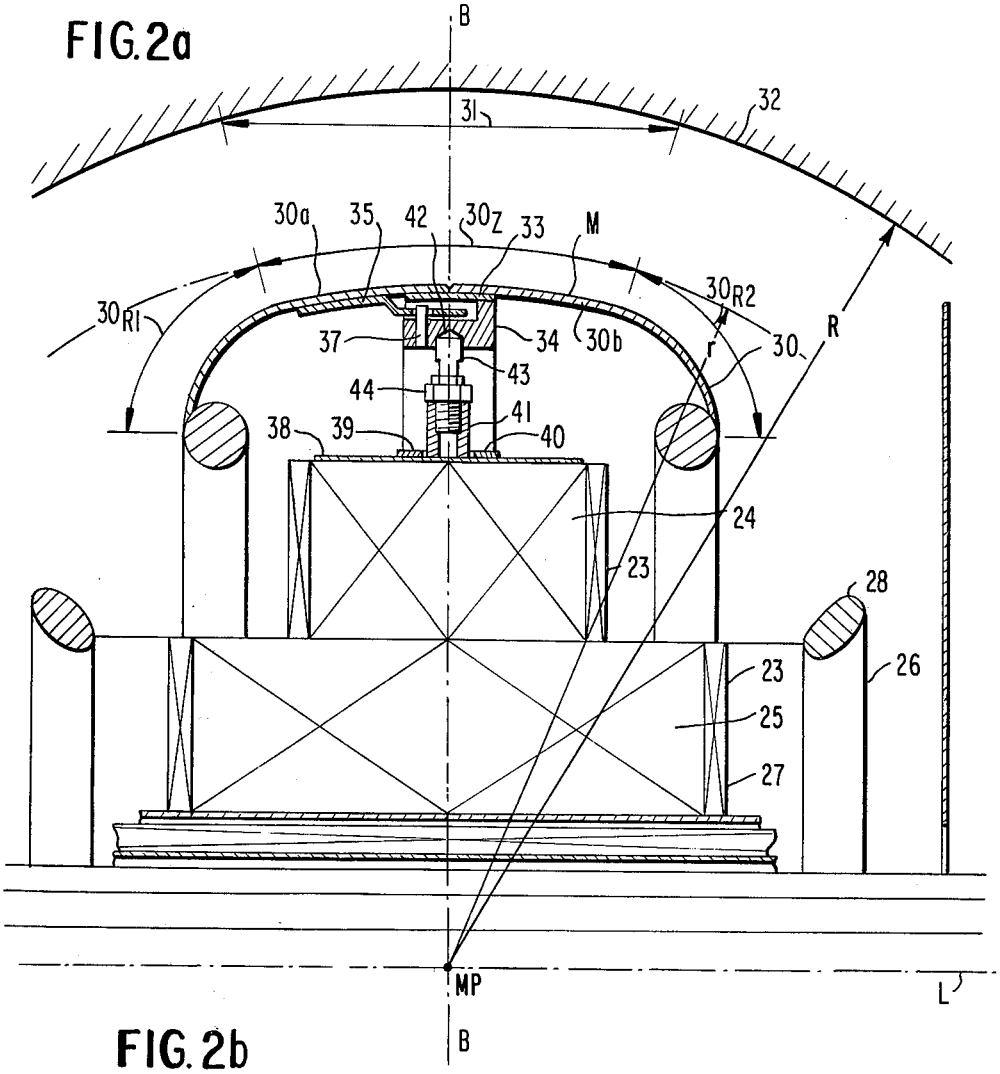
Figure 2B:
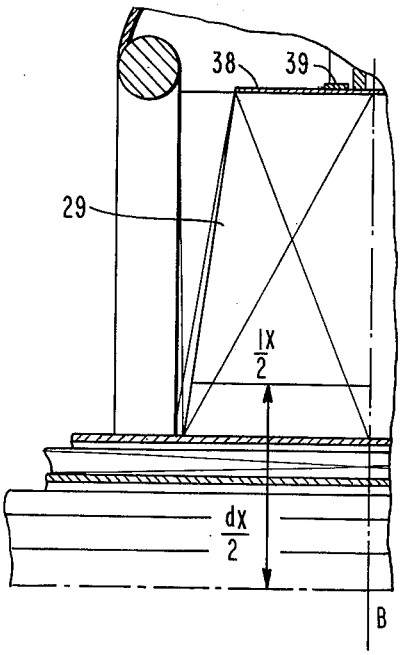
Figure 3:
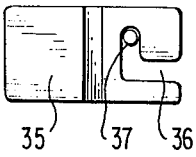

These and further objects, features and advantages of the present invention will become more apparent from the following description when taken in connection with the accompanying drawing which shows, for purposes of illustration only, two embodiments in accordance with the present invention, and wherein:

FIG. 1*a* is a schematic, longitudinal cross-sectional view through an inductive voltage transformer according to the present invention with a winding of rectangular cross section; and FIG. 1*b* is a partial view of a winding of trapezoidal cross section utilizable in the FIG. 1*a* arrangement;

FIG. 2*a* is a schematic, longitudinal cross-sectional view, on an enlarged scale in comparison to FIG. 1, through one-half of a modified embodiment of an inductive voltage transformer according to the present invention having high-voltage electrode halves detachably connected with each other and with a winding of rectangular cross section;

FIG. 2*b* is a partial view of the winding of trapezoidal cross section corresponding to FIG. 2*a* arrangement;

FIG. 3 is a plan view on a detail of the stucture according to the present invention for locking together the detachable high-voltage electrode halves.

Referring now to the drawing wherein like reference numerals are used throughout the various views to designate like parts, and more particularly to FIG. 1*a*, the high-voltage winding 1 of this figure which is constructed as layer winding, is coaxially surrounded by a high-voltage electrode 2 which is composed of two halves 2*a* and 2*b* that are symmetrical to the longitudinal center plane thereof. For reasons of a more simple manufacture and for reasons of a cost- and weight-savings, the high-voltage electrode halves 2*a* and 2*b* are made of sheet-metal stampings or pressed-out plate or sheet-metal parts, preferably of light-metal plate or sheet-material such as aluminum or aluminum alloys. In principle, however, also a continuously subdivided high-voltage electrode made of solid material could be used. The edges of the high-voltage electrode halves 2*a* and 2*b* shown as parts 3*a* and 3*b* in the plane of division A — A (i.e., in the longitudinal center plane) are drawn inwardly in the direction toward the high-voltage winding 1, along which the high-voltage electrode halves are soldered together, welded together, riveted together or detachably connected with each other, for example, by means of screws or bolts, prior to mounting thereof at the high-voltage winding 1. The subdivision of the high-voltage electrode 2, preferably in the longitudinal center plane A—A, therefore takes place only for reasons of a more simple manufacture. In order to simplify the subsequent mounting of the high-voltage electrode 2 at the completed high-voltage winding 1, a detachable connection of the two electrode havles 2*a* and 2*b* is particularly advantageous as will be described hereinafter in connection with FIGS. 2*a* and 3. In the construction with a material-locking connection of the two electrode halves 2*a* and 2*b*, the high-voltage electrode 2 is not only slotted in a plane perpendicular to the subdivision plane A—A in order to avoid a short-circuit winding, but is continuously subdivided within this plane (not shown) in order to be able to guide the thus-produced electrode halves over the completed high-voltage winding 1 radially from the outside and to be able to detachably connect the same with each other under accommodation and mounting of an electrically insulating insulating disk. This subsequent installation possibility of the high-voltage electrode 2 offers the further advantage that the insertion of the core into the completed high-voltage winding 1 is not impaired.

The high-voltage electrode 2 includes a central portion $2_Z$ surrounding the high-voltage winding 1 constructed as layer winding or at least a portion thereof as well as edge portions $2_{R1}$ and $2_{R2}$ axially drawn over the layer winding. The central portion $2_Z$ and the edge portions $2_{R1}$ and $2_{R2}$ of the high-voltage electrode 2 are so curved and the rim portions $2_{R1}$ and $2_{R2}$ are so far drawn inwardly in the direction toward the longitudinal axis L of the high-voltage winding 1 that the outer surface M of the high-yoltage electrode 2 together with the adjacent cylindrical wall portions 4 of the pressure vessel 5 form at least approximately a Rogowski-profile projected on a cylinder field or area (see also FIG. 2). The dash-and-dotted, semicircularly shaped line in FIG. 1 indicates thereby the pressure vessel radius R. With a view toward a constant surface field strength and therewith toward a homogeneous field with uniform stress of the insulating gas forming the high-voltage insulation, which may preferably be an inert or electronegative gas such as nitrogen or sulfahexafluoride; it is of advantage if the central portion $2_Z$ of the high-voltage electrode 2 has a radius of curvature *r* which possesses at least approximately a common center point MP together with the radius of curvature R of the pressure vessel 5. In the case of a layer winding with identical layer lengths, the center portion $2_Z$ of the high-voltage electrode 2 is approximately as wide as the layer winding inclusive the laterally projecting layer insulations 6. With the use of a layer winding have a layer width continuously increasing in the direction of a decreasing potential (trapezoidal winding, winding with equal inductive and capacitive voltage distribution or the like), the central portion $2_Z$ is approximately as wide as the outermost winding layer disposed at high-voltage potential inclusive the laterally projecting layer insulations. Together with the edge portions $2_{R1}$ and $2_{R2}$ laterally adjoining the central portion $2_Z$ which possess the same but smaller radii of curvature than the central portion $2_Z$, one obtains a tight coupling and therewith an effective shielding of the high-voltage winding 1.

The high-voltage winding can be constructed as layer winding with rectangular winding cross section 7, i.e., with identical layer lengths. Such a winding is characterized in particular by a uniform a.c. voltage distribution. It can also be mechanically manufactured in a very simple manner. In case one aims at a far-reaching uniform inductive and capacitive voltage distribution, the high-voltage winding can also be constructed as layer winding with trapezoidally shaped winding cross section 8, as is illustrated in FIG. 1*b*. In this case, the high-voltage electrode 2 surrounds only a portion, and more particularly approximately the first third of the trapezoidal winding 8. The shielding effect of the high-voltage electrode 2, however, is still completely sufficient also for this embodiment. This is true in particular if additionally an intermediate electrode 9 with electrode edges 12 and 13 axially projecting over the winding end faces 10 and 11 is provided in the winding plane having approximately half the high-voltage potential. The intermediate electrode 9 consists preferably of a metal tape or web, for example, of copper or of a copper alloy, wound into the layer winding 7 with rectangular cross section or into the trapezoidal winding 8. The electrode edges 12 and 13 of the intermediate electrode 9 which may consist of solid material, but preferably consists of pressed-out or stamped-out sheet-metal material for reasons of weight-saving, may be connected with the wound-in metal tape or web by soldering, riveting or the like. One obtains an inherently sturdy, vibration-resistant winding structure by winding-in the intermediate electrode 9, whereby the metal web or tape of the intermediate electrode 9 serves as winding body for the upper winding portion disposed at higher potential.

The high-voltage electrode 2 surrounds the high-voltage winding 1 in a freely supporting or cantilever-like manner; it is merely fastened at the high-voltage outlet or lead-out line 14 exclusively by means of a threaded connection or the like, which in its turn is carried by a preferably funnel-shaped terminal insulator 16 clamped to the coupling flange 15 of the transformer. The pressure vessel is adapted to be flangedly connected in a gas-tight manner to the metal encapsulation 50 of a swich-gear installation partially illustrated in FIG. 1*a*. The potential connection between the high-voltage winding 1 and the high-voltage outlet line or lead-out 14 is established by way of a flexible connecting line 17. Large tolerances in the winding height can be permitted due to the freely supporting arrangement of the high-voltage electrode 2 in relation to the high-voltage winding 1 and to the flexible connection of the winding connection on the high-voltage side with the high-voltage outlet line or lead-out, because these large tolerances are absorbed inside the high-voltage electrode 2. Additionally, one obtains separate fastening points for the active parts of the transformer with respect to the pressure vessel 5, on the one hand, and the support of the high-volage outlet line or lead-out 14 at the terminal insulator 16, on the other.

The iron core 18 may be inserted subsequently into the completed high-voltage winding 1 in a conventional, known manner and may be fixed with respect to the pressure vessel 5 by means of a conventional core pressing frame (not shown). For purposes of further uniformity of the electric field, a sheet-metal shield 19 completely lining the core window and consisting of sheet-metal parts gaplessly assembled at one another is provided which are slotted at the end faces radially to the core leg axis for purposes of avoiding a short-circuit winding.

The high-voltage winding 1 is supported as a unit by a high-voltage winding pipe 20, into which the low-voltage winding 21 is inserted and fastened in a customary manner. The outlet lines or lead-out of the low-voltage or secondary winding are extended through a gas-tight bushing 22 to the connecting terminals in the terminal box.

Paper or synthetic plastic foil tapes which have proved themselves heretofore may be used as layer insulations 6 in the transformer construction especially with the use of gaseous insulating substances. The interior space of the pressure vessel 5 is in communication by way of a valve (not shown) with the insulating gas volume of the high-voltage metal-clad switch-gear installation. The pressure vessel 5 may be constructed preferably as light-metal cast housing or as welded steel plate housing. The active parts of the transformer—iron core 18 as well as high and low voltage windings 1 and 21—are secured at the pressure vessel 5 by means of holding elements of conventional type (not shown) mounted at the core pressing frame. The terminal insulator 16 is thus mechanically loaded and stressed only by the weight of the high-voltage outlet line or lead-out 14 and of the high-voltage electrode 2 of light-weight material and light-weight construction.

In case the tolerances in the winding height of the high-voltage winding can be kept sufficiently small or in case a tolerance compensation is made possible at another place of the transformer, for example, at the transition of the high-voltage electrode to the high-voltage outlet line, the high-voltage electrode can be made of two identical pressed-out sheet-metal parts or stampings for purposes of simplification of the installation which can be assembled from opposite directions. The pressed-out sheet metal parts or stampings may be detachably connected with each other by means of a bayonet connection and may be fastened on the high-voltage winding by a clamping fit. Such a construction of the shielding electrode is illustrated in FIGS. 2*a* and 3. FIGS. 2*a* and 2*b* additionally illustrates further possibilities for the construction of the high-voltage winding.

In order to maintain the favorable properties of a high-voltage layer winding with rectangular winding cross section and in order to simultaneously improve the surge-voltage strength and classification accuracy, the high-voltage winding, as is illustrated in FIG. 2*a* may also be constructed as simple stepped or offset layer winding 23 with rectangular winding cross section of the winding parts thereof. The two rectangular winding parts 24 and 25 with different layer lengths are series-connected electrically. At the transitions between the winding parts 24 and 25 an intermediate electrode 26 is provided which projects axially over the winding end faces 27 of the lower winding portion 25 with larger layer width and is at the potential of the uppermost layer of the winding part 25, preferably at an intermediate potential. The construction of the intermediate electrode 26 is advantageously the same as that of the intermediate electrode 9 in the embodiment according to FIG. 1*a*. A preferred modification, however, results from the fact that the electrode edges 28 thereof made of stamped-out or pressed-out sheet metal parts are enlarged outwardly trumpet-shaped. As a result thereof, one obtains relatively large radii of curvature at the electrode edges 28 without uneconomically high material, weight, and space requirements. Of course, also in the embodiment according to FIG. 1*a*, the edges of the intermediate electrode could be constructed correspondingly. The principle of the light-weight construction of all shielding electrode parts is still further enhanced by this electrode construction. The connection of the electrode edges 28 with the intermediate electrode-metal tape or web may again be established by soldering, riveting or the like. With higher voltage ranges, the layer winding 23 may also include more than two steps and may be provided with an intermediate electrode on each partial winding. As a result thereof, the surge-voltage strength of the high-voltage winding can be still further improved.

In case an at least approximately equal inductive and capacitive voltage distribution (alternating current and surge voltage distribution) is desired in the high-voltage winding, the layer winding 29 may be preferably so constructed that it has a layer width steadily decreasing in the direction of increasing potential, as is illustrated in FIG. 2*b* to the left of the longitudinal center plane B—B. The layer length of the $x^{th}$ layer must thereby satisfy the following equation:

$$l_x = \sqrt{\text{const.} \cdot \ln \frac{d_x}{d_{x-1}}} \; ;$$

wherein $l_x$ = layer length of the $x^{th}$ layer
$d_x$ = diameter of the $x^{th}$ layer
$d_{x-1}$ = diameter of the layer preceding the $x^{th}$ layer
$l_n$ ' natural lorarithm
const. = a constant which is so selected that the necessary overall number of windings inclusive the required layer insulation can be accommodated in a predetermined winding cross section.

The high-voltage electrode coordinated to the high-voltage winding 23 or 29 is designated by reference numeral 30. The high-voltage electrode 30 again consists of two halves 30*a* and 30*b* symmetrical to the center longitudinal plane B—B, preferably of stamped or pressed-out light metal sheet material, especially aluminum. the radii of curvature of the electrode central portion $30_Z$ and of the rim portions $30_{R1}$ and $30_{R2}$ axially drawn over the high-voltage winding 29 and 30 and the coordination thereof to the adjacent cylindrical wall part 31 of the pressure vessel 32, on the one hand, and to the high-voltage winding 23 or 29, on the other, are constructed and chosen as in the embodiment according to FIG. 1*a*. Omitted are exclusively the inwardly drawn, circumferential parts 3*a* and 3*b* arranged within the partition plane A—A in the previously described embodiment and the material- or form-locking connection thereof.

A circumferential sheet metal guide member 33 for the other electrode half 30*a* is fastened at the one electrode half 30*b*, which simultaneously serves for the reinforcing and strengthening of the shield electrode 30. Three locking parts 34, preferably mutually offset by about 120°, are fastened at the circumference of the sheet metal guide member 33 which together with corresponding latching parts 35 at the electrode half 30*a*, distributed in a similar manner, form a bayonet connection. A plan view on one of the latching parts 35 provided with an angularly bent guide groove 36 for a locking pin 37 is illustrated in FIG. 3. Two circumferential guide strips 39 and 40 are fastened at the outermost layer 38 of the high-voltage winding 23 or 29, which is preferably constructed as metal shield, between which are arranged three threaded bushes 41 also mutually offset by about 120°. One of these threaded bushes 41 is fixedly soldered together with the metal shield whereas the other two bushes are slidingly arranged between the guide strips 39 and 40 in order to compensate for a possible offset in the coordination of the locking parts 34 to the threaded bushes 41. Threaded pins 43 screwed into the threaded bushes 41 serve for radially clamping the electrode halves 30*a* and 30*b* bayonet-like locked together; the threaded pins 43 enable a radial clamping of the shielding electrode 30 with the high-voltage winding 23 or 29 by clamping action in dead-end-like bores 42 provided in the locking members 34. After the centering and the clamping of the shielding electrode 30 by means of the threaded pins 43 uniformly distributed along the circumference of the high-voltage winding 23 or 29, the counter nuts 44 mounted on the threaded pins 43 are tightened. The connection of the shielding electrode 30 with the outlet line or lead-out pipe (not shown) can take place by conventional connecting angle members (also not shown). For purposes of avoiding a short-circuit winding, it suffices to slot the high-voltage electrode 30 on one side within a plane perpendicular to the longitudinal center plane B—B. An axial subdivision into two halves is not necessary because the electrode halves 30*a* and 30*b* are laterally slipped over the completed high-voltage winding 23 or 29 and can be connected with each other by the bayonet connection.

The spoke-shaped support of the high-voltage electrode 30 on the high-voltage winding 23 or 29 assures an intimate, vibration-resistant connection between the shielding electrode and the high-voltage winding. In case the spoke-shaped support elements 33, 34, 40, 41 and 43 therebeyond consist of a resistance material, they may be used simultaneously for damping discharge currents of no-load lines. The same effect can also be achieved in that one manufatures the high-voltage lead-out or outlet line itself of resistance material or in that it contains a winding of resistance wire. Such a winding could be installed into a high-voltage line made of synthetic resinous casting material, for example, by the use of conventional centrifugal casting processes.

For the purpose of further fastening the high-voltage winding, it is of advantage if the individual winding layers and/or layer insulations are additionally fixed by gluing substances or the like. Attention must be paid in that connection that the impregnation of the individual winding layers with the insulating gas is not impaired. For purposes of strengthening also the surface of the layer insulations can be rendered so soft by a coating or other suitable measures that the individual wire windings press into the layer insulations as a result of the winding tension. As a result of the additional strengthening of the high-voltage winding, it is possible to flangedly connect the transformer to the high-voltage switch-gear installation in any desired installed position.

The voltage transformer according to the present invention is characterized by an extraordinarily favorable field utilization by reason of the previously described construction of the high-voltage electrode and the coordination thereof to the high-voltage winding in cooperation with the intermediate electrode or electrodes. As a result thereof, the high breakdown strength of the insulating gas can be fully utilized at increased pressure with the consequence that the insulating distances and therewith the dimensions of the transformer can be kept small. The voltage transformer according to the present invention can also be used as test transformer.

While we have shown and described two embodiments in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. An inductive voltage transformer insulated by an insulating gas and including a pressure vessel means and a high-voltage winding means which is surrounded by a high-voltage electrode means, the insulating gas within the pressure vessel means forming the high-voltage insulation, characterized in that the high-voltage electrode means is axially drawn over the winding end faces of at least a part of the high-voltage winding means, said high-voltage electrode means including a central portion surrounding the winding cross section of the high-voltage winding means as well as edge portions axially projecting over the high-voltage winding means, said central portion and said edge portions being so curved that the outer surfaces thereof together with adjacent wall portions of the pressure vessel means form at least approximately a Rogowski-profile projected on a cylinder area, said central portion of said high-voltage electrode means and the adjacent wall portions of the pressure vessel means representing in cross section concentric partial circles having at least approximately a common center point of curvature with said edge portions of said high-voltage electrode means having smaller radii of curvature than said central portion so as to form a Rogowski-profile.

2. A voltage transformer according to claim 1, characterized in that the voltage transformer is for a high-voltage metal-clad switch-gear installation fully insulated by means of an insulating gas, while the pressure vessel means is arranged for flanged gas-tight connection to the metal encapsulation of the switch-gear installation.

3. A voltage transformer according to claim 1, characterized in that the high-voltage electrode means surrounds the high-voltage winding means substantially coaxially.

4. A voltage transformer according to claim 1, characterized in that the adjacent wall portions of the pressure vessel means are substantially cylindrical.

5. A voltage transformer according to claim 1, characterized in that the high-voltage winding means is constructed as a layer winding and has at least one intermediate electrode means axially projecting over the winding end faces thereof.

6. A voltage transformer according to claim 5, characterized in that the high-voltage winding means includes several intermediate electrode means axially projecting over the winding end faces thereof.

7. A voltage transformer according to claim 5, characterized in that the free ends of a respective intermediate electrode means widen trumpet-shaped in the outward direction.

8. A voltage transformer according to claim 5, characterized in that at least one of the high-voltage electrode means and the intermediate electrode means consists of assembled sheet-metal stampings.

9. A voltage transformer according to claim 8, characterized in that both the high voltage electrode means and the intermediate electrode means consist of sheet-metal stampings.

10. A voltage transformer according to claim 8, characterized in that the high-voltage elecrode means is assembled of two substantially symmetrical sheet-metal stampings.

11. A voltage transformer according to claim 10, characterized in that the sheet-metal stampings are detachably connected with each other.

12. A voltage transformer according to claim 11, characterized in that the sheet-metal stampings are connected with each other by means of a bayonet connection.

13. A voltage transformer according to claim 12, characterized in that a respective intermediate electrode means is constructed as metal tape means and is wound into the high voltage winding means, the edge portions of the high voltage winding means being electrically connected with the intermediate electrode tape means.

14. A voltage transformer according to claim 13, characterized in that the edge portions are made of sheet-metal stampings.

15. A voltage transformer according to claim 12, characterized in that the high-voltage electrode means is secured to and supported at a high-voltage lead-out means and surrounds the high voltage winding means.

16. A voltage transformer according to claim 15, characterized in that the high-voltage electrode means is secured on the high-voltage winding means by a clamping fit means and the high-voltage lead-out means is flexibly connected with the high-voltae electrode means.

17. A voltage transformer according to claim 16, characterized in that the high-voltage electrode means is supported by spoke-shaped support elements on the high-voltage winding means.

18. A voltage transformer according to claim 17, characterized in that the spoke-shaped support elements consist of resistance material.

19. A voltage transformer according to claim 15, characterized in that the high-voltage lead-out means consists of resistance material.

20. A voltage transformer according to claim 15, characterized in that the high-voltage lead-out means contains at least one winding of resistance wire.

21. A high-voltage transformer according to claim 15, characterized in that the high-voltage winding means surrounded by the high-voltage electrode means has a substantially rectangular cross section.

22. A voltage transformer according to claim 21, characterized in that the high-voltage winding means with substantially rectangular winding section is offset at least once, in that an intermediate electrode means axially projecting over the winding edge is provided at each winding step and in that the width of the winding steps decreases with increasing potential.

23. A voltage transformer according to claim 22, characterized in that the high-voltage winding means is offset several times.

24. A high-voltage transformer according to claim 15, characterized in that the high-voltage winding means surrounded by the high-voltage electrode means has a trapezoidally winding cross section.

25. A voltage transformer according to claim 15, characterized in that the high-voltage winding means surrounded by the high-voltage electrode means has a layer width steadily decreasing in the direction of increasing potential, the layer width varying in dependence on the layer number such that the inductive and capacitive voltage distribution are at least approximately equal.

26. A voltage transformer according to claim 15, characterized in that the individual winding layers and the layer insulations are so fastened that the transformer is constructed for flanged connection to a high-voltage switch-gear installation in any desired installed position thereof.

27. A voltage transformer according to claim 15, characterized in that the voltage transformer is for a high-voltage metal-clad switch-gear installation fully insulated by means of an insulating gas, while the pressure vessel means is arranged for flanged gas-tight connection to the metal encapsulation of the switch-gear installation.

28. A voltage transformer according to claim 2, characterized in that the individual winding layers and the layer insulations are so fastened that the transformer is constructed for flanged connected to the high-voltage switch-gear installation in any desired installed position thereof.

29. A voltage transformer according to claim 1, characterized in that the high-voltage electrode means consists of assembled sheet-metal stampings.

30. A voltage transformer according to claim 1, characterized in that the high-voltage electrode means is assembled of two substantially symmetrical sheet-metal stampings.

31. A voltage transformer according to claim 30, characterized in that the sheet-metal stampings are detachably connected with each other.

32. A voltage transformer according to claim 30, characterized in that the sheet-metal stampings are connected with each other by means of a bayonet connection.

33. A voltage transformer according to claim 5, characterized in that a respective intermediate electrode means is constructed as metal tape means and is wound into the hgh voltage winding means, the edge portions of the high-voltage winding means being electrically connected with the intermediate electrode tape means.

34. A voltage transformer according to claim 33, characterized in that the edge portions are made of sheet-metal stampings.

35. A voltage transformer according to claim 1, characterized in that the high-voltage electrode means is secured to and supported at a high-voltage lead-out means and surrounds the high-voltage winding means.

36. A voltage transformer according to claim 1, characterized in that the high-voltage electrode means is secured on the high-voltage winding means by a clamping fit means and the high-voltage lead-out means is flexibly connected with the high-voltage electrode means.

37. A voltage transformer according to claim 1, characterized in that the high-voltage electrode means is supported by spoke-shaped support elements on the high-voltage winding means.

38. A voltage transformer according to claim 37, characterized in that the spoke-shaped support elements consist of resistance material.

39. A voltage transformer according to claim 35, characterized in that the high-voltage lead-out means consists of resistance material.

40. A voltage transformer according to claim 35, characterized in that the high-voltage lead-out means contains at least one winding of resistance wire.

41. A high-voltage transformer according to claim 1, characterized in that the high-voltage winding means surrounded by the high-voltage electrode means has a substantially rectangular cross-section.

42. A voltage transformer according to claim 1, characterized in that the high-voltage winding means with substantially rectangular winding section is offset at least once, in that an intermediate electrode means axially projecting over the winding edge is provided at each winding step and in that the width of the winding steps decreases with increasing potential.

43. A voltage transformer according to claim 42, characterized in that the high-voltage winding means is offset several times.

44. A high-voltage transformer according to claim 1, characterized in that the high-voltage winding means surrounded by the high-voltage electrode means has a trapezoidally winding cross section.

45. A voltage transformer according to claim 1, characterized in that the high-voltage winding means surrounded by the high-voltage electrode means has a layer width steadily decreasing in the direction of increasing potential, the layer width in dependence on the layer number such that the inductive and capacitive voltage distribution are at least approximately equal.

* * * * *